US005962567A

United States Patent [19]

Geoffrey et al.

[11] Patent Number: 5,962,567

[45] Date of Patent: Oct. 5, 1999

[54] BOUND MULTI-COMPONENT SAND ADDITIVE

[75] Inventors: Michael M. Geoffrey, Lombard; Robert A. Laitar, Woodridge, both of Ill.

[73] Assignee: Borden Chemical, Inc., Columbus, Ohio

[21] Appl. No.: 08/725,548

[22] Filed: Oct. 3, 1996

Related U.S. Application Data

[62] Division of application No. 08/391,038, Feb. 21, 1995, Pat. No. 5,621,036.

[51] Int. Cl.[6] ..... C08K 9/04; B22C 1/20

[52] U.S. Cl. ..... 524/431; 523/139; 523/143; 523/145; 523/204; 428/402; 428/404; 428/407

[58] Field of Search ..... 524/431; 523/139, 523/143, 145, 204; 428/402, 404, 407

[56] References Cited

U.S. PATENT DOCUMENTS

| | | | |
|---|---|---|---|
| Re. 32,812 | 12/1988 | Lemon et al. | 523/145 |
| Re. 34,092 | 10/1992 | Henry | 523/145 |
| 3,234,159 | 2/1966 | Cooper | 523/143 |
| 4,051,301 | 9/1977 | Laitar | 428/404 |
| 4,134,442 | 1/1979 | Laitar | 164/43 |
| 4,362,203 | 12/1982 | Konii et al. | 164/16 |
| 4,426,467 | 1/1984 | Quist et al. | 523/145 |
| 4,452,928 | 6/1984 | Trischman et al. | 523/201 |
| 4,459,374 | 7/1984 | Nishimura et al. | 523/145 |
| 4,478,269 | 10/1984 | Akerberg | 523/143 |
| 4,785,040 | 11/1988 | Gupta et al. | 524/445 |
| 4,789,597 | 12/1988 | Gupta et al. | 428/407 |
| 4,862,948 | 9/1989 | Laitar | 523/145 |
| 4,994,505 | 2/1991 | Gerber | 523/145 |
| 5,001,011 | 3/1991 | Plueddeman | 523/213 |
| 5,028,482 | 7/1991 | Jeffs | 523/205 |
| 5,354,788 | 10/1994 | Johnson et al. | 523/143 |
| 5,856,378 | 1/1999 | Ring et al. | 428/407 |

*Primary Examiner*—James J. Seidleck
*Assistant Examiner*—Olga Asinovsky
*Attorney, Agent, or Firm*—Stevens, Davis, Miller & Mosher, L.L.P.

[57] ABSTRACT

Two or more sand additive particles are made to adhere to each other, using a binder. The finished product consists of free-flowing particles that are composed of the additive particles bound together by the binder. These bound additive particles may then be applied to sand, such as foundry sands, where, otherwise, multiple additions of additive might need to be made. The pH of the single additive particles can be controlled and separation of the additives due to different specific gravities can be avoided. Various mixtures of different additives are disclosed. Methods of controlling particle size of additive particles, tendency to generate dust, degrade tensile strength or control thermal expansion of foundry cores or molds by using bound additive particles are also disclosed.

14 Claims, No Drawings

BOUND MULTI-COMPONENT SAND ADDITIVE

This is a division of application Ser. No. 08/391,038, filed Feb. 21, 1995, now U.S. Pat. No. 5,621,036.

BACKGROUND OF THE INVENTION

1. Field of the Invention

This invention relates to improved processes of introducing additives into a base product, such as sand, particularly foundry sand, and to new articles of manufacture, i.e., free flowing particles that are composed of two or more additives, the additives being bound together with a binder.

2. Background of the Invention

The addition of additives to sand, particularly to foundry sand, is a well established art. Additives such as soda lime cullet are presently being used, under the tradename of Veinguard™, as a foundry sand additive for the control of expansion defects in ferrous castings. Other additives known in the field include iron oxide. Under present practice, additives to foundry sands are each added independently of any other additives. By "added independently" we mean that there is a separate measuring or metering step for each additive. Alternatively, the additives are blended "dry" and then introduced into the foundry sand mix.

Whether the additives are separately introduced or dry blended with each other before introduction into the foundry sand, the additives are typically mixed dry with a core or mold sand, and then a binder is coated onto the resultant mixture. The coated mixture is placed into a pattern that gives it its final shape, and then it is cured. The cured shape, e.g., core or mold, is then used in the making of metal castings. If the sand mixing part of the process uses a continuous mixer or an automatic batch mixer, then it is likely that the dry additives will be added in an automated fashion. This will typically be accomplished by using a metering feeder. Two additives will then require two feeders, three additives will require three feeders, and so on.

Simply pre-blending the dry additives before putting them through the metering feeder may result in a loss of control over the amount of each additive that ends up in the sand mixture.

If the specific gravities of the additives are reasonably different, then separation of the pre-blended additives will readily occur. One means of reducing the likelihood of this type of separation is to reduce the particle size of the additive components to be pre-blended and then couple them using any of a variety of surface active coupling agents (silanes, for example). The small particle size of the additive reduces the mass that these surface active agents are required to hold together. The relatively weak adsorptive forces by which these surface active agents function would be overwhelmed by particles much larger than fine powders.

However, using additives that have a small particle size relative to the sand is a disadvantage. These small particles, generally referred to as fines, will reduce the core or mold strength, relative to a fixed binder level for the sand mixture and lesser amount of fines, because of an increase in the surface area that the binder is required to coat.

Another disadvantage of using an additive in the form of fine particle size, or fines, is that, as the percentage of fines increases, the more the additive is prone to generating dust when handled. Yet another disadvantage is that increasing the percentage of fines in a core or mold will decrease the ability of the core or mold to vent decomposition gases. It would be an advantage to make the particle size of the additive as close to that of the size of the sand particle as is practicable, but this will generally lead to the problem of the components separating from each other unless the components are sufficiently bound together.

Another disadvantage of adding additives to a foundry sand mix is that the pH of the sand mix is a factor affecting curing of some foundry sand binders. Additives having a pH near one end or other of the pH scale will affect the rate of cure of some binders. Accordingly, it would be advantageous if the additive added to foundry sand had a neutral pH.

OBJECTS OF THE INVENTION

It is therefore an object of the invention to provide novel products and processes for introducing at least two additives (i.e., a multi-component particle) into a sand mix, particularly a foundry sand mix.

It is a further object of the invention to provide two or more additives for a foundry sand mix using a binder for the foundry sand wherein the additives have a neutral pH.

It is a still further object of the invention to provide multiple additives to an automated foundry sand mixing process wherein only a single metering apparatus is necessary to meter multiple additives.

It is another object of the invention to provide two or more foundry sand additives as a free-flowing particle having a particle size approximating the particle size of the individual grains comprising the foundry sand.

It is a still further object of the invention to provide a process for binding together two or more additive particles and to provide free flowing particles which are composed of bound components having different physical and/or chemical properties.

These and other objects will become apparent from the following description of the invention.

SUMMARY OF THE INVENTION

One embodiment of the invention discloses a free-flowing particle for use as a foundry sand additive, said particle including two or more particles of different foundry sand additives, said different foundry sand additives being adhered to each other by the use of an additive binder.

Another embodiment of the invention is a sand mix comprising a foundry sand and free-flowing additive particles, wherein the free-flowing additive particles comprise at least two different additives bound together by an additive binder.

A further embodiment of the invention is a process for introducing additives into a foundry sand, said process comprising providing at least two different foundry sand additives together using an additive binder to obtain free-flowing particles comprising said at least two different foundry sand additives, and introducing said free-flowing particles into a foundry sand.

A still further embodiment of the invention is a method of controlling the pH of additives added to a foundry sand mix, said method comprising the steps of providing a foundry sand additive having a pH above or below neutral, and at least partially coating said additive with a polymer material having a neutral pH.

Another embodiment of the invention is a method for controlling the particle size and size distribution of the additive to eliminate problems associated with finely divided particles such as the tendency to generate dust and the tendency to significantly reduce the strength of the foundry core or mold made containing the additive.

Yet another embodiment of the invention is to provide a method of introducing additives for the control of the thermal expansion of cores or molds that is more effective in controlling expansion than the use of the individual unbound additives.

DETAILED DESCRIPTION OF THE PREFERRED EMBODIMENTS

In the present invention at least two different additives for a foundry sand mix are bound together through the use of an additive binder. By "additive binder" is meant a substance which binds the additive particles together.

Suitable additive binders include polymerizable materials, such as a polymeric binder. decomposable or vaporizable at the temperature of the molten metal contacting the foundry sand containing such polymeric binders. Examples of suitable polymeric binder materials include thermoplastic or thermosetting resins, such as phenolic resins. However, any binder, such as a cement, thermoplastic, or a glass, would be suitable binders.

The additives which may be bound together by the binder may include two or more known foundry sand additives. Examples of such additives include any useful chemical additives and other additives known in the foundry industry such carbon and/or graphite, glass cullet, fused silica, black iron oxide, red iron oxide, clays, minerals, alumina, plant flours and titanium dioxide and mixtures thereof. Plant flours include wood flour, cob flour, dextrin and starches.

The additive binder should harden or cure so as to produce a free-flowing particle comprising two or more additive particles bound together. The additive binder adheres the additive components together while at the same time acting as at least a partial, and sometimes complete, coating for the additive particles. Careful selection of the additive binder type and chemistry will allow neutralization of the additives.

The amount of additive binder added to the additives must be sufficient to adhere the additives together to form larger particles, although as noted above, the amount of additive binder need not be so large as to completely cover the additive particles. The viscosity of a polymeric binder can be readily adjusted by modification of the molecular weight of the polymer itself, the use of solvents for the polymer, the introduction of dispersants or surface active agents, etc. While variation in several of these factors may be performed individually or in combination, the result should be the formation of additive binder suitable for forming a particle containing at least two components of different physical and/or chemical properties, e.g., two foundry sand additives.

The size of the resulting free flowing particles of additives will be greater than that of the additive particles themselves and can be regulated so as to approximate the size of the foundry sand particles. Regulation of the size of the particle depends upon the amount and composition of the additive binder, as noted above, as well as upon the type of mixing equipment and parameters of the process employed, i.e., length of mixing time. When mixed with a polymeric binder, the individual additive particles should no longer segregate from each other, even if their specific gravities differ significantly from each other.

Dusting of the additives is also significantly reduced. A simple test procedure has been designed to evaluate dusting.

Veinseal 12000 (a product of Industrial Gypsum Inc., Milwaukee, Wis.) is a commercialized blend of silica, alumina and iron oxide. Macor 1032 (a product of J. S. McCormick Co., Pittsburgh, Pa.) is sold in a variety of compositions based on carbohydrates, clays, iron oxides, carbon and alumina.

Both Veinseal 12000 and Macor 1032 are dry blends of their components. When viewed under the microscope at 320×, Veinseal 12000 is visually separated into light and dark colored fractions, characteristic of its components. When a sample according to the invention, containing magnetite and soda lime cullet, is viewed under the same conditions, bonding of the magnetite to the soda lime cullet is readily apparent.

When 3 grams of Veinseal 12000, Macor 1032 and the foregoing sample according to the invention are each placed in separate vials and these in turn are shaken on a Labline orbital shaker for 10 minutes at 300 rpm, the sample according to the invention remains homogeneous, while Veinseal 12000 shows striations indicative of separation of its components. Macor 1032 is less readily separated due to the fineness of the particles making up the blend.

Both Veinseal 12000 and Macor 1032 are composed of fine individual components. Veinseal 12000 has an American Foundrymen Society (AFS) grain fineness number (GFN) of 140, while Macor 1032 has an AFS GFN of 207. The following Table I compares the screen distributions from one embodiment of the invention, Veinseal 12000 and Macor 1032.

TABLE I

Comparison of Screen Distributions

| Screen | Embodiment of the Invention % Retained | Veinseal 12000 % Retained | Macor 1032 % Retained |
|---|---|---|---|
| 30 | 0 | 0.12 | 0.7 |
| 40 | 0.1 | 0.32 | 1.2 |
| 50 | 1.5 | 1.38 | 1.9 |
| 70 | 39.7 | 6.33 | 5.5 |
| 100 | 37.5 | 21.88 | 11.6 |
| 140 | 17.0 | 21.71 | 9.0 |
| 200 | 3.6 | 21.22 | 8.9 |
| 270 | 0.4 | 11.78 | 10.4 |
| pan | 0.1 | 15.26 | 50.7 |
| GFN | 70 | 140 | 207 |

The differences in GFN are important to the application of these additives. The larger the GFN the more prone the product is to generating dust on handling, reducing tensile strengths because of the increased surface area a foundry sand binder is required to cover, and reducing core permeability thereby increasing the likelihood of gas related defects in a casting.

When glass jars containing equal amounts of Veinseal 12000 and Macor 1032 are shaken, they both generate dust which is visible in the headspace of the jar. Under the same conditions, the embodiment according to the invention does not generate dust. While it is true that these dry blends could be made using larger particle sizes on the individual components, to do so would aggravate separation of the components. This is evident in the comparison of Veinseal 12000 and Macor 1032. Veinseal 12000 at a GFN of 140 readily shows separation as compared to Macor 1032 at a GFN of 207 which is less easily separated.

The following Examples will further illustrate the disclosed invention.

The bound multi-component additives, prepared according to this invention, were tested for use in foundry core and mold making applications. The process of core and mold making for the foundry industry is well known. In one method, resin binders are mixed with aggregate and the resulting mixture is cured into a hard durable shape. The method used to make cores for testing as described in the following examples is the "cold box" phenolic urethane process. In this process, the binder system consists of two parts, namely, a part one phenolic polyol resin and a part two polymeric isocyanate resin. These two parts are mixed with foundry aggregate and the resulting mixture is blown into a core box that has the required shape. A gaseous tertiary amine catalyst is then passed through the blown shape and the part one and part two components react to form a hard durable urethane. This method of making cores was chosen for its convenience and the application of the disclosed invention is in no way limited to the "cold box" phenolic urethane core making process.

For these examples, lake sand was added to a Kitchen Aid mixer. The mixer was started and either a bound multi-component additive was mixed into the sand, or the unbound individual additive components were mixed into the sand. A part one resin and a part two resin were then mixed into the sand/additive blend. This foundry mix was blown into a core box using a Redford CBT-1 core blower. Cores were blown at 50 psi air pressure, gassed for three seconds with triethylamine, then purged with air at 30 psi pressure for five seconds. Cores thus prepared, formed American Foundrymen's Society 1-inch "dog-bone" briquettes.

These cores were subjected to tensile testing at various times after the cure time. Cores thus made will increase in tensile strength, up to a maximum value, as they age beyond the time of cure. Data collected as function of core age comprises results referred to as tensile build. An uncured portion of the sand/additive/binder mixture was allowed to stand exposed to the laboratory environment for a period of time. At various times after mixing, cores were made from the mixture. As the mixture ages, tensile strengths of cores made from the mixture will decrease below the values collected for a fresh mix. Sand/additive conditions such as an elevated alkalinity or an elevated pH will accelerate the rate of tensile strength degradation as a function of mix age. Data collected as a function of mix age comprises results referred to as bench life.

Tensile strengths of the cores prepared as noted above were determined using a Thwing-Albert Tensile Tester (Philadelphia, Pa.). This device consists of jaws that accommodate the ends of the "dog-bone". A load is then applied to each end of a "dog-bone" as the jaws are moved away from each other. The application of an increasing load continues until the "dog-bone" breaks. The load at this point is termed the tensile strength, and it has units of psi.

Unless otherwise indicated, all percentages expressed in this specification are "by weight".

EXAMPLE

Soda Lime Cullet having an American Foundrymen Society (AFS) grain fineness number (GFN) of 88 and magnetite (black iron oxide (B.I.O.)) having an AFS GFN of 212 were combined together with a silane and a phenolic resin. Table 2 itemizes the weights of each component. Table 3 details the procedure used to generate the finished product. This product was designated Ex33908.

TABLE 2

| Component | Weight (g) |
|---|---|
| Soda Lime Cullet | 750 |
| Magnetite | 250 |
| Silane | 0.2 |
| Phenolic Resin | 20 |

A typical manufacturing procedure is a follows:

1. Dry mix dry additives to uniformly disperse components.
2. Heat to 340° F. while mixing.
3. When at temperature add phenolic resin and continue mixing.
4. 30 seconds after phenolic resin is added, add silane.
5. Mix to an elapsed time of 6 minutes.
6. Post bake 12 minutes at 350° F. with no mixing.
7. Sieve through a 40 mesh screen.

Ex33908 was then added to silica sand at 7.8% based on sand weight. This allows 5.7% Soda Lime Cullet and 1.9% magnetite to be added with each 7.8% of Ex33908. The resulting AFS GFN was 70. Tables 3 and 4 give the results of tensile testing.

TABLE 3

Results of Tensile Testing - Effect on Tensile Bond

| | 5.9% Cullet 2.0% B.I.O. | 7.8% Ex33908 |
|---|---|---|
| Core Age | Tensile Strength (psi) | |
| at gassing | 102 | 125 |
| one hour | 135 | 173 |
| 24 hours | 125 | 163 |
| 24 hours @ 90% RH | 107 | 127 |
| 24 hours @ 100% RH | 40 | 48 |

TABLE 4

Results of Tensile Testing - Effect on Bench Life

| | 5.9% Cullet 2.0% B.I.O. | 7.8% Ex.33908 |
|---|---|---|
| Sand Mix Age | Tensile Strength at gassing (psi) | |
| 0 hour | 102 | 125 |
| 1 hours | 62 | 93 |
| 2 hours | 42 | 77 |
| 3 hours | 22 | 68 |
| 4 hours | 0 | 57 |
| 5 hours | 0 | 52 |

By combining the soda lime cullet and magnetite in the phenolic resin, the ultimate pH of the additive was significantly improved. Table 5 shows the pH values of the components of Ex33908 and Ex33908 itself. The pH is measured from a suspension, consisting of 50 grams of deionized water and 50 grams of the additive, that has been mixed for 5 minutes.

TABLE 5

| Benefit of Binding Additive Components on pH | |
|---|---|
| Additive | pH |
| Soda Lime Cullet | 10.7 |
| Magnetite | 7.5 |
| Dry Mix of 75% Soda Lime Cullet 25% Magnetite | 9.7 |
| Ex33908 | 7.0 |

Additional examples have been prepared using soda lime cullet and red iron oxide (R.I.O.), and also soda lime cullet, black iron oxide (B.I.O.) and alumina. The results of testing these materials is presented in the attached Tables 6 through 11.

For example, Ex42850 soda lime cullet and R.I.O. were combined, according to the methods of this invention, to form a bound product composed of 83.70% soda lime cullet, 11.96% R.I.O., 4.30% phenolic resin, and 0.04% silane. Ex42850 was then mixed with lake sand at 5% (w/w), based on the weight of the sand. To this mixture was applied 1.6%, by weight of sand of a phenolic urethane cold box binder system, and cores were made by blowing the aggregate-Ex42850-binder mixture into a core box, as previously described, and then applying to the resulting shapes a triethylamine gaseous catalyst. The resulting cores were then tested for strength. Additionally, cylindrical cores were made by ramming a known weight of the aggregate-Ex42850-binder mixture into tubes, and curing the resulting shapes with the triethylamine catalyst. The cylindrical cores were 1¼ inches in diameter and 2 inches in length. These cores were used to test the expansion characteristics of the systems.

Tensile testing for tensile build characteristics and bench life were done as previously described. Testing for expansion characteristics was done on a device that allows for the determination of free horizontal expansion. In this test, cores lay, horizontally, on a quartz tray inside an oven maintained at 1000° C. A quartz stylus lightly contacts one end of the core, and as the core expands, this stylus pushes against a low-resistance indicator that measures the displacement of the stylus. From these displacement values, collected as a function of time at 1000° C., the core expansion as inches per inch may be calculated.

Table 6 shows the effect of Ex42850 on tensile build as compared to the effect of an amount of soda lime cullet and R.I.O. equivalent in weight to that being added as components of Ex42850. Cores were made from aggregate containing the individual unbound components in the same manner as cores were made where Ex42850 was applied to the aggregate. As the results demonstrate, consistent with the examples given thus far, the bound additive product less negatively impacts tensile build than the use of the individual unbound components. Similarly, the advantage of the invention is realized in the results of Table 7. Here, bench life is less negatively impacted by the use of Ex42850, than it is by the use of the individual unbound components.

Table 8 shows the unexpected benefit of a reduced core expansion where Ex42850 is used, as compared to that realized when the individual unbound components are applied. This benefit is of significant value when the additives are being used to reduce core expansion under the elevated temperatures caused by molten metal. Cores can expand when exposed to molten metal to the point where they crack. Metal then fills these cracks resulting in protruding Fins or veins in the finished casting. These fins or veins, if accessible, must be removed by machining. This can be a costly process for the foundry. If the fins or veins occur in an inaccessible region of the casting, the casting will be scrapped and generally remelted. When this occurs, the lost production rate can be quite significant.

An example of a three-component system has also been prepared. For Ex42829, 66.13% soda lime cullet, 5.96% alumina, 24.03% B.I.O., 3.84% phenolic resin and 0.04% silane were combined to form a bound product embodied by this invention. The results of testing this product are presented in Tables 9, 10 and 11.

In Table 9, the effect of Ex42829 on tensile build is compared to the effect of the individual bound components. Tensile specimens were prepared and tested consistent with all other examples presented herein. Consistent with the results demonstrated thus far, the use of the bound multi-component additive results in improved tensile strength development. Similarly, the use of the bound multi-component additive results in an improved bench life.

Table 11 again demonstrates the surprising result that the use of a bound multi-component additive causes lesser core expansion than occurs when the individual unbound components are used. The benefits of this property are the same as discussed above, for example Ex42850.

TABLE 6

| Results of Tensile Testing - Effect on Tensile Build Additional Example of Two-Component System | | |
|---|---|---|
| | 4.2% Cullet 0.6% R.I.O. | 5% Ex42850 |
| Core Age | Tensile Strength (psi) | |
| At gassing | 231 | 242 |
| One hour | 305 | 334 |
| 24 hours | 365 | 380 |
| 24 hours at 90% RH | 208 | 230 |
| 24 Hours at 100% RH | 96 | 114 |

TABLE 7

| Results of Tensile Testing - Effect on Bench Life Additional Example of Two-Component System | | |
|---|---|---|
| | 4.2% Cullet 0.6% R.I.O. | 5% Ex42850 |
| Sand Mix Age | Tensile Strength (psi) | |
| 0 hours | 231 | 242 |
| 1 hour | 204 | 223 |
| 2 hours | 189 | 206 |
| 3 hours | 179 | 195 |

TABLE 8

| Results of Expansion Testing - Effect on Core Expansion Example of Two-Component System | | |
|---|---|---|
| | 4.2% Cullet 0.6% R.I.O. | 5% Ex42850 |
| Time at 1000° C. | Expansion, in./in. × 100 | |
| 15 seconds | 0.32 | 0.24 |
| 30 seconds | 0.58 | 0.44 |
| 60 seconds | 0.79 | 0.62 |
| 90 seconds | 1.03 | 0.75 |

TABLE 8-continued

Results of Expansion Testing - Effect on Core Expansion
Example of Two-Component System

| Time at 1000° C. | 4.2% Cullet 0.6% R.I.O. | 5% Ex42850 |
|---|---|---|
| | Expansion, in./in. × 100 | |
| 120 seconds | 1.33 | 1.01 |
| 150 seconds | 1.67 | 1.33 |
| 180 seconds | 1.89 | 1.63 |
| 210 seconds | 2.02 | 1.79 |
| 240 seconds | 2.08 | 1.81 |
| 270 seconds | 2.08 | 1.81 |
| 300 seconds | 2.08 | 1.81 |

TABLE 9

Results of Tensile Testing - Effect on Tensile Build
Additional Example of Three-Component System

| Core Age | 3.3% Cullet 1.2% B.I.O. 0.3% Alumina | 5% Ex42829 |
|---|---|---|
| | Tensile Strength (psi) | |
| At gassing | 202 | 222 |
| One hour | 261 | 303 |
| 24 hours | 294 | 339 |
| 24 hours at 90% RH | 198 | 236 |
| 24 Hours at 100% RH | 114 | 118 |

TABLE 10

Results of Tensile Testing Effect on Bench Life
Additional Example of Three-Component System

| Sand Mix Age | 3.3% Cullet 1.2% R.I.O. 0.3% Alumina | 5% Ex42850 |
|---|---|---|
| | Tensile Strength (psi) | |
| 0 hours | 202 | 222 |
| 1 hour | 191 | 212 |
| 2 hours | 183 | 203 |
| 3 hours | 172 | 192 |

TABLE 8

Results of Expansion Testing - Effect on Core Expansion
Example of Three-Component System

| Time at 1000° C. | 3.3% Cullet 1.2% B.I.O. 0.3% Alumina | 5% Ex42850 |
|---|---|---|
| | Expansion, in./in. × 100 | |
| 15 seconds | 0.29 | 0.29 |
| 30 seconds | 0.50 | 0.52 |
| 60 seconds | 0.67 | 0.69 |
| 90 seconds | 0.84 | 0.87 |
| 120 seconds | 1.13 | 1.13 |
| 150 seconds | 1.48 | 1.43 |
| 180 seconds | 1.78 | 1.73 |
| 210 seconds | 2.00 | 1.87 |
| 240 seconds | 2.02 | 1.89 |
| 270 seconds | 2.02 | 1.89 |
| 300 seconds | 2.02 | 1.89 |

Although the foregoing description has emphasized the use of such bound additive particles in the foundry industry, it is readily apparent that the invention has utility wherever particles of differing physical and/or chemical properties need to be added, metered or mixed with another substance. Thus, the invention should not be construed to be limited to the foundry industry but has general utility in other additive containing industries, such as particle board making and the industrial resin industries.

Having now disclosed our invention, it is readily apparent to those skilled in the art that modifications and variations may be made without departing from the spirit or scope of the appended claims.

We claim:

1. A sand mix comprising a foundry sand and a free-flowing foundry sand additive particle, said particle consisting essentially of at least two bound discrete, solid particulates of a material useable as a foundry sand additive, each of said foundry sand additive materials being selected so as to alter the properties of a foundry sand to which it is added, and each of said free-flowing particles consisting of foundry sand additive particulates, wherein at least one of said foundry sand additive particulates differs in at least one of its physical or chemical properties from the other foundry sand additive particulate in the free-flowing particle, wherein each of said at least two foundry sand additive particulates are adhered to each other by a binder which is hardened or cured to form said free-flowing particle before mixing with foundry sand.

2. A sand mix comprising a foundry sand and a free-flowing foundry sand additive particle of claim 1 wherein the binder is a polymeric material.

3. A sand mix comprising a foundry sand and a free-flowing foundry sand additive particle of claim 1 wherein the free-flowing particle is of a size approximating a foundry sand particle with which it is to be mixed.

4. A sand mix comprising a foundry sand and a free-flowing foundry sand additive particle of claim 1 wherein the foundry sand additive is selected to alter the property of thermal expansion.

5. A sand mix comprising a foundry sand and a free-flowing foundry sand additive particle of claim 1 wherein the binder also acts as a foundry sand additive.

6. A sand mix comprising a foundry sand and a free-flowing foundry sand additive particle of claim 1 wherein the binder is phenolic resin and the particles are glass cullet and iron oxide.

7. Cured shapes of a sand mix according to claim 1 further comprising a polymeric binder for said foundry sand.

8. A foundry mold or core made by using the sand mix of claim 7.

9. A sand mix comprising a foundry sand and a free-flowing foundry sand additive particle of claim 1, wherein said physical property is different particle size.

10. A sand mix comprising a foundry sand and a free-flowing foundry sand additive particle of claim 1, wherein at least one of the additives has a pH which is not neutral and said binder has a neutral pH.

11. A sand mix comprising a foundry sand and a free-flowing foundry sand additive particle, said particle consisting essentially of at least two bound particulates of foundry sand additives, at least one foundry sand additive selected from the group consisting of carbon, graphite, glass cullet, fused silica, black iron oxide, red iron oxide, clays, minerals, alumina, plant flours and titanium dioxide, wherein each of said foundry sand additives on said free-flowing particle are adhered to each other by a binder which is hardened or cured to form said free-flowing particle before mixing with foundry sand.

12. A sand mix comprising a foundry sand and a free-flowing foundry sand additive particle of claim 10 wherein the binder is selected from the group consisting of polymeric, cement and glass binders.

13. A sand mix comprising a foundry sand and a free-flowing foundry sand additive particle of claim 1 wherein the binder is selected from the group consisting of polymeric, cement and glass binders.

14. A sand mix comprising a foundry sand and a free-flowing foundry sand additive particle of claim 1 wherein the foundry sand additive particulates differ in their pH and the binder is a polymeric material which at least partially coats said foundry sand additive particulates.

* * * * *